US008883274B2

(12) United States Patent
Kawasaki et al.

(10) Patent No.: US 8,883,274 B2
(45) Date of Patent: Nov. 11, 2014

(54) INK JET RECORDING MATERIAL

(75) Inventors: Masahiro Kawasaki, Tokyo (JP); Toru Kaneko, Tokyo (JP); Satoshi Kaneko, Tokyo (JP); Daichi Miyake, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 92 days.

(21) Appl. No.: 13/389,819

(22) PCT Filed: Aug. 11, 2010

(86) PCT No.: PCT/JP2010/063621

§ 371 (c)(1), (2), (4) Date: Feb. 10, 2012

(87) PCT Pub. No.: WO2011/019052

PCT Pub. Date: Feb. 17, 2011

(65) Prior Publication Data

US 2012/0148767 A1 Jun. 14, 2012

(30) Foreign Application Priority Data

Aug. 12, 2009 (JP) ..... 2009-187414
Mar. 31, 2010 (JP) ..... 2010-082079

(51) Int. Cl.
*B41M 5/00* (2006.01)
*B41M 5/50* (2006.01)
*B41M 5/52* (2006.01)

(52) U.S. Cl.
CPC ..... *B41M 5/502* (2013.01); *B41M 5/506* (2013.01); *B41M 5/52* (2013.01); *B41M 5/5218* (2013.01); *B41M 2205/38* (2013.01)
USPC ..... 428/32.1; 428/32.25; 428/32.34; 428/32.36

(58) Field of Classification Search
CPC ..... B41M 5/5218; B41M 5/52; B41M 5/506
USPC ..... 428/32.1, 32.25, 32.34, 32.36
See application file for complete search history.

(56) References Cited

U.S. PATENT DOCUMENTS

| | | | | |
|---|---|---|---|---|
| 2003/0039930 | A1 | 2/2003 | Aylward et al. | |
| 2003/0072925 | A1 * | 4/2003 | Kiyama et al. | 428/195 |
| 2006/0182903 | A1 | 8/2006 | Sakaguchi et al. | |

FOREIGN PATENT DOCUMENTS

| | | | | | |
|---|---|---|---|---|---|
| EP | 1 284 436 | A1 | | 2/2003 | |
| EP | 1 580 017 | A1 | | 9/2005 | |
| JP | 2003-80836 | A | | 3/2003 | |
| JP | 2004-276418 | A | | 10/2004 | |
| JP | 2004-276419 | A | | 10/2004 | |
| JP | 2005-288884 | A | | 10/2005 | |
| JP | 2006-218785 | A | | 8/2006 | |
| JP | 2008-194970 | A | | 8/2008 | |
| JP | 2010 046 822 | A | * | 3/2010 | B41M 5/00 |

* cited by examiner

*Primary Examiner* — Betelhem Shewareged
(74) *Attorney, Agent, or Firm* — Birch, Stewart, Kolasch & Birch, LLP

(57) ABSTRACT

An ink jet recording material comprises at least two layers of ink-receptive layers mainly containing inorganic fine particles having an average secondary particle size of 500 nm or less on a resin-coated paper having a resin layer on at least one surface of a base paper, and the ink-receptive layer nearer to the support contains a pearlescent pigment.

7 Claims, No Drawings

INK JET RECORDING MATERIAL

BACKGROUND OF THE INVENTION

1. Field of the Invention

The present invention relates to an ink jet recording material which is a recording material used for an ink jet recording system.

2. Description of the Related Art

As a recording material to be used for an ink jet recording system, there has been known an ink jet recording material in which an ink-receptive layer is provided on a support. The ink-receptive layer is roughly classified into 2 kinds. One is an ink-receptive layer comprising a water-soluble polymer as a main component, and the other is a porous ink-receptive layer comprising an inorganic pigment and a resin binder as main components.

The former ink-receptive layer absorbs ink into the water-soluble polymer by swelling. The latter ink-receptive layer absorbs ink in voids formed by the inorganic pigment. Due to such a difference in ink absorption mechanisms, the former is called as a swelling type (or a polymer type), and the latter as a void type (or a microporous type).

The swelling type ink-receptive layer gives high glossiness since it becomes a continuous and uniform coating film, but involves the problem that it is inferior in ink absorbability (ink absorption rate and drying rate after printing). On the other hand, the latter void type ink-receptive layer is excellent in ink absorbability and thus preferred.

As the inorganic pigment contained in the void type ink-receptive layer, there have been proposed to use inorganic fine particles such as fumed silica and wet process silica which had been pulverized and dispersed to have an average secondary particle size of 500 nm or less. Examples of using fumed silica may be mentioned, for example, JP H10-119423A, JP 2000-211235A, JP 2000-309157A, etc., and examples of using pulverized precipitation method silica may be mentioned, for example, JP H9-286165A, JP H10-181190A, etc. Also, examples of using pulverized gel method silica may be mentioned, for example, JP 2001-277712A, etc., and with regard to inorganic pigments other than silica, a recording material using alumina or alumina hydrate is mentioned, for example, in JP S62-174183A, JP H2-276670A, JP H5-32037A, JP H6-199034A, etc.

The above-mentioned void type ink-receptive layer has excellent ink absorbability, as well as excellent glossiness, image clarity, and coloring property by utilizing the inorganic fine particles having an average secondary particle size of 500 nm or less.

On the other hand, it has been generally known to use a paper support such as uncoated paper, art paper, coated paper, cast-coated paper, etc., a resin-coated paper which uses these paper supports as a base paper and at least one surface of which has been coated by a resin, or a resin film, etc., as the support of the ink jet recording material. However, these paper supports and the base paper for the resin-coated paper cause fine unevenness (hereinafter referred to as surface unevenness or "Menshibo") at the surface thereof at the time of paper-making. When a porous ink-receptive layer containing the above-mentioned inorganic fine particles having an average secondary particle size of 500 nm or less is provided on a paper support having surface unevenness, or on a resin-coated paper in which at least one surface of a base paper having surface unevenness is coated by a resin, high glossiness, ink absorbability and image clarity can be obtained, but on the other hand, there is a problem of causing a feel of surface unevenness due to extremely high transparency of the ink-receptive layer itself. The feel of surface unevenness particularly and conspicuously appears as the glossiness of the recording material becomes high.

Various proposals have been made on a method for preparing a paper support or a base paper having excellent smoothness. For example, in JP S58-68037A, desired distribution of a fiber length has been proposed by a sieving method of pulp fibers obtained by beating of a pulp. Also, in JP S59-42295B, it has been proposed to regulate the starting pulp by its optical characteristics to solve the problem of smoothness, in JP S63-173045A, it has been proposed to formulate a pulp having a viscosity of the pulp of 5 to 12 centipoises, and in JP H6-67341A, it has been proposed a paper substrate which uses a bleached kraft pulp of hardwood (LBKP) and beats under specific conditions. However, each was not sufficiently satisfied.

It has also been known to use a matting agent in an ink-receptive layer of an ink jet recording material and has been disclosed in, for example, JP H11-321080A, JP 2001-341409A, JP 2004-1449A, JP 2007-125781A, etc. The above-mentioned feel of surface unevenness can be overcome by adding a matting agent to the ink-receptive layer, but glossiness, image clarity, and coloring property are lowered. Accordingly, it has been desired to develop an ink jet recording material in which the feel of surface unevenness has canceled without lowering glossiness, image clarity, and coloring property.

It has conventionally been known to use a pearlescent pigment for an ink jet recording material, and, for example, in JP 2004-276418A (Patent Literature 1), an ink jet recording material in which a silver white type pearlescent pigment is contained in a resin layer or an undercoat layer at the side of a resin-coated paper having an ink-receptive layer has been disclosed. Also, in JP 2004-276419A (Patent Literature 2), an ink jet recording material in which an interference color type pearlescent pigment is contained in a resin layer or an undercoat layer at the side of a resin-coated paper having an ink-receptive layer has been disclosed. Further, in JP 2003-80836A (Patent Literature 3), an ink jet recording material having a pearlescent layer containing a pearlescent pigment, a metal salt and a binder resin on a support has been disclosed, in JP 2005-288884A (Patent Literature 4), an ink jet recording material in which a pearlescent pigment is added to an ink-receptive layer mainly containing inorganic fine particles has been disclosed, and in JP 2006-218785A (Patent Literature 5), an ink jet recording material in which a pearl-like gloss layer is provided on an ink-receptive layer mainly containing inorganic fine particles has been disclosed.

However, these ink jet recording materials were each not a recording material which satisfy all of ink absorbability, glossiness, image clarity, coloring property and a feel of surface unevenness.

Also, a sheet-state ink jet recording material is generally cut to a predetermined size by a device such as a cutter, guillotine, etc., after an ink-receptive layer is continuously coated on a roll-state support in which a long support has been wound. However, in an ink jet recording material having a void type ink-receptive layer, the problems frequently occurred that powder of the ink-receptive layer which had been crushed at the edge portion accompanied by the cutting attached to a sheet (hereinafter referred to as powder dropping), and a sheet-state ink jet recording material slipped when it was transferred in a printer by transferring rollers to cause paper-feeding failure or paper output failure, or an image was not correctly printed due to the presence of powder attached to the sheet-state ink jet recording material. This problem was particularly and conspicuously occurred in an ink jet recording material having a void type ink-receptive layer which contained a pearlescent pigment.

[Patent Literature 1] JP 2004-276418A
[Patent Literature 2] JP 2004-276419A
[Patent Literature 3] JP 2003-80836A
[Patent Literature 4] JP 2005-288884A
[Patent Literature 5] JP 2006-218785A

SUMMARY OF THE INVENTION

Problems to be Solved by the Invention

An object of the present invention is to provide an ink jet recording material in which a feel of surface unevenness is canceled without impairing ink absorbability, glossiness, image clarity and coloring property.

Means to Solve the Problems

The above-mentioned problems of the present invention can be basically accomplished by an ink jet recording material comprising at least two ink-receptive layers mainly containing inorganic fine particles having an average secondary particle size of 500 nm or less on a support, and a pearlescent pigment being contained in the ink-receptive layer nearer to the support.

An amount of the pearlescent pigment in the ink-receptive layer nearer to the support mentioned above is preferably in the range of 3 to 35% by weight based on the amount of the solid component of the inorganic fine particles having an average secondary particle size of 500 nm or less.

Also, it is preferred that the ink-receptive layer contains a hydrophilic binder, a ratio of the amount (weight) of the hydrophilic binder based on the total amount (weight) of the inorganic fine particles and the pearlescent pigment contained in the ink-receptive layer nearer to the support is larger than a ratio of the amount (weight) of the hydrophilic binder based on the amount (weight) of the inorganic fine particles contained in the ink-receptive layer apart from the support, and the said ratio in the ink-receptive layer nearer to the support is 0.4 or less.

Here, it is preferred that a ratio of the amount (weight) of the hydrophilic binder based on the amount (weight) of the inorganic fine particles contained in an ink-receptive layer apart from the support is in the range of 0.05 to 0.25.

Moreover, it is preferred that an amount of the pearlescent pigment to be added to the ink-receptive layer nearer to the support is in the range of 3 to 24% by weight based on the amount of the solid component of the inorganic fine particles having an average secondary particle size of 500 nm or less.

Furthermore, it is preferred that the above-mentioned support is a resin-coated paper which is a material having a resin layer on at least one surface of a base paper.

Effects of the Invention

According to the present invention, it can be provided an ink jet recording material in which a feel of surface unevenness is canceled without impairing ink absorbability, glossiness, image clarity, and coloring property.

DETAILED DESCRIPTION OF THE INVENTION

In the following, the present invention will be explained in detail.

The ink jet recording material of the present invention has at least two layers of ink-receptive layers mainly containing inorganic fine particles having an average secondary particle size of 500 nm or less on a support, and an ink-receptive layer nearer to the support contains a pearlescent pigment. In the following explanation, an ink-receptive layer nearer to the support is called an ink-receptive layer A. Also, an ink-receptive layer provided at the position apart from the support than said ink-receptive layer A is called an ink-receptive layer B.

The pearlescent pigment means a pigment which shows glossiness like a surface of pearl as the name shows, and is clearly classified from the other white pigment. In the pearlescent pigments to be used in the present invention, there are natural products such as fish scale and natural mica, and synthetic products of a material in which the surface of basic lead carbonate, bismuth oxychloride, natural mica is coated by a metal oxide, and a material in which the surface of synthetic mica is coated by a metal oxide. Among these, in the points of easily available and safety, those in which a surface of natural mica is coated by a metal oxide or a surface of synthetic mica is coated by a metal oxide are preferably used, and in the viewpoints of glossiness and image clarity, the pearlescent pigment preferably has a plate shape. Here, the terms plate shape mean that an aspect ratio (average particle diameter/average particle thickness) of the pearlescent pigment is 5 or more, more preferred pearlescent pigment has an average particle thickness of 0.2 to 0.9 μm, an average particle diameter of 1 to 200 μm, and an aspect ratio of 5 to 200. Such a pearlescent pigment may be mentioned titanium dioxide-coated mica, iron oxide-coated mica, titanium dioxide coated alumina oxide flake, bismuth oxychloride, etc., and for example, it is commercially available from MERCK & CO. as the names of Iriodin 100, Iriodin 103, Iriodin 111, Iriodin 123, Xirallic T50-10 Crystal Silver, etc., from NIHONKO-KEN Co., Ltd. as a PEARL-GLAZE series under the names of MB-100RF, ME-100R, MF-100R, MM-100R, etc., and from the other manufacturers with the same purpose, and various kinds of grades can be easily obtained.

The pearlescent pigment is preferably used for the preparation of a coating solution of an ink-receptive layer A after mixing a pearlescent pigment and dispersing media by a propeller type stirrer, a turbine type stirrer, a homomixer type stirrer, etc., to prepare a pearlescent pigment dispersion.

In the present invention, an amount of the pearlescent pigment to be added to the ink-receptive layer A is preferably in the range of 3 to 50% by weight based on the solid amount of the inorganic fine particles having an average secondary particle size of 500 nm or less. If it is less than 3% by weight, there is a case where an effect as a pigment is sometimes not sufficiently shown, while if it exceeds 50% by weight, there is a case where a function as an ink-receptive layer is not sufficiently shown due to lowering in ink absorbability, or stability on production is poor due to insufficient dispersibility. More preferred amount of the pearlescent pigment to be added is in the range of 3 to 35% by weight.

The ink-receptive layer B may also contain the pearlescent pigment, but it is desirably a small amount in the viewpoints of image clarity and coloring property, and more specifically, the amount is preferably 3% by weight or less based on the solid amount of the inorganic fine particles having an average secondary particle size of 500 nm or less. Also, it is preferred that the ink-receptive layer B of the present invention does not substantially contain the pearlescent pigment to be used in the ink-receptive layer A of the present invention in the viewpoints of image clarity and coloring property. Here, the terms "does not substantially contain" mean that the amount is 1.6% by weight or less based on the solid content coated amount of the inorganic fine particles having an average secondary particle size of 500 nm or less contained in the ink-receptive layer B. Thus, even when the ink-receptive layer B contain the pearlescent pigment, the amount to be added is an extremely small amount as mentioned above, so that a ratio of the hydrophilic binder in the ink-receptive layer B of the present invention mentioned below is defined to be a ratio based on the inorganic fine particles having an average secondary particle size of 500 nm or less. However, when the ink-receptive layer B contains the pearlescent pigment, said ratio is calculated as a ratio based on the total amount of the inorganic fine particles having an average secondary particle size of 500 nm or less and the pearlescent pigment.

In the present invention, the ink-receptive layer A and the ink-receptive layer B both mainly contain the inorganic fine particles having an average secondary particle size of 500 nm or less. In the present invention, the secondary particle means particles in which the primary particles are agglomerated, and the average secondary particle size thereof means an average particle diameter of the agglomerated primary particles. Here, "mainly contain" means that the inorganic fine particles having an average secondary particle size of 500 nm or less is contained in both of the ink-receptive layer A and the ink-receptive layer B in an amount of 50% by weight or more based on the whole solid component of the ink-receptive layer, preferably 60% by weight or more. The upper limit is 95% by weight or so. By mainly containing said inorganic fine particles, the ink-receptive layers become porous with higher void ratio whereby ink absorbability is improved. Also, by making an average secondary particle size of the inorganic fine particles small as 500 nm or less, more excellent glossiness, image clarity, and coloring property can be obtained.

As the inorganic fine particles having an average secondary particle size of 500 nm or less contained in the ink-receptive layer A and the ink-receptive layer B of the present invention, there may be mentioned light calcium carbonate, heavy calcium carbonate, magnesium carbonate, kaolin, titanium dioxide, zinc oxide, zinc hydroxide, calcium silicate, magnesium silicate, synthetic silica, alumina, alumina hydrate, magnesium hydroxide, etc., and a mixture of 2 or more kinds mentioned above. Among these, synthetic silica, alumina or alumina hydrate is preferred, since these inorganic fine particles give high printing density and clear image, and are advantageous in cost. More preferred inorganic fine particles in the present invention are amorphous synthetic silica, alumina or alumina hydrate.

The amorphous synthetic silica can be roughly classified into wet process silica and fumed silica according to the preparation method. The fumed silica is also called to as the dry process silica contrary to the wet process silica, and it can be generally prepared by a flame hydrolysis method. More specifically, it has generally been known a method in which silicon tetrachloride is burned with hydrogen and oxygen, and silanes such as methyltrichlorosilane, trichlorosilane, etc., may be used in place of silicon tetrachloride, singly or in admixture with the silicon tetrachloride. The fumed silica is commercially available as AEROSIL from NIPPON AEROSIL K.K., and as QS TYPE from K.K. TOKUYAMA.

The wet process silica can be further classified into a precipitation method silica, a gel method silica, and a sol method silica according to the preparation processes. The precipitation method silica can be prepared by reacting sodium silicate and sulfuric acid under alkali conditions, silica particles grown in particle size agglomerated and precipitated, and then, they are processed through filtration, washing, drying, pulverization and classification to prepare a product. Secondary particles of the silica prepared by this method become gently agglomerated particles and relatively easily pulverizable particles can be obtained. As the precipitation method silica, it is commercially available, for example, as NIPSIL from TOSOH SILICA CORPORATION, and as TOKUSIL from K.K. TOKUYAMA. The gel method silica can be produced by reacting sodium silicate and sulfuric acid under acidic conditions. During ripening, fine particles are dissolved and reprecipitation occurs so as to combine other primary particles to each other, so that clear primary particles disappear and relatively hard agglomerated particles having internal void structure are formed. It is commercially available, for example, as NIPGEL from TOSOH SILICA CORPORATION, as Mizukasil from Mizusawa Industrial Chemicals, Ltd., and as SYLOID or SYLOJET from Grace Japan Co., Ltd. The sol method silica is also called to as colloidal silica and can be obtained by heating and ripening silica sol obtained by metathesis of sodium silicate by using an acid, etc., or passing through an ion-exchange resin layer, and is commercially available, for example, as SNOWTEX from NISSAN CHEMICAL INDUSTRIES, LTD.

The fumed silica which can be used in the present invention is explained. An average primary particle size of the fumed silica to be used in the present invention is preferably 30 nm or less, and more preferably 15 nm or less to obtain higher glossiness. More preferred are to use those having an average primary particle size of 3 to 15 nm, and having a specific surface area measured by the BET method of 200 $m^2/g$ or more (preferably 250 to 500 $m^2/g$). Incidentally, the average primary particle size referred to in the present invention means an average particle size of fine particles using 100 primary particles existing in a predetermined surface area and diameters of the circles thereof equivalent to the projected surface area of the respective primary particles according to electron microscopic observation as a particle size, and the BET method mentioned in the present invention means one of methods for measuring a surface area of powder material by a gas phase adsorption method and is a method for obtaining a total surface area possessed by 1 g of a sample, i.e., a specific surface area, from an adsorption isotherm. In general, as an adsorption gas, a nitrogen gas has frequently been used, and a method of measuring an adsorption amount obtained by the change in pressure or a volume of a gas to be adsorbed has most frequently been used. Most famous equation for representing isotherm of polymolecular adsorption is a Brunauer-Emmett-Teller equation which is also called to as a BET equation and has widely been used for determining a surface area of a substance to be examined. A surface area can be obtained by measuring an adsorption amount based on the BET equation and multiplying the amount with a surface area occupied by the surface of one adsorbed molecule.

In the ink-receptive layer A and the ink-receptive layer B of the present invention, fumed silica dispersed to have an average secondary particle size of 500 nm or less, preferably 10 to 300 nm in the presence of a cationic polymer can be used. To make an average secondary particle size of said fumed silica 500 nm or less, it is preferred to provisionally mix the fumed silica and dispersing medium by using general propeller stirring, turbine type stirring, homomixer type stirring, etc., and then, disperse the same by using a media mill such as a ball mill, a beads mill, a sand grinder, etc., a pressure type dispersing machine such as a high pressure homogenizer, a ultra-high pressure homogenizer, etc., a ultrasonic wave dispersing machine, and a thin film spin system disperser, etc. Incidentally, the average secondary particle size referred to in the present invention can be obtained by photographing the obtained ink-receptive layer of the recording material, and it can be simply obtained by measuring a dispersion using a LASER SCATTERING TYPE PARTICLE SIZE DISTRI- BUTION ANALYZER (for example, manufactured by HORIBA, Ltd., LA920), and measuring a median diameter per number of particles.

As the cationic polymer to be used for dispersing the above-mentioned fumed silica, preferably used are polyethyleneimine, polydiallylamine, polyallylamine, alkylamine polymer, as well as polymers having a primary to tertiary amino group or a quaternary ammonium group as disclosed in JP S59-20696A, JP S59-33176A, JP S59-33177A, JP S59-155088A, JP S60-11389A, JP S60-49990A, JP S60-83882A, JP S60-109894A, JP S62-198493A, JP S63-49478A, JP S63-115780A, JP S63-280681A, JP H1-40371A, JP H6-234268A, JP H7-125411A, JP H10-193776A, etc. In particular, a diallylamine derivative is preferably used as the cationic polymer. A weight average molecular weight of these cationic polymers is preferably 2,000 to 100,000 or so, particularly preferably 2,000 to 30,000 or so in view of dispersibility and a viscosity of the dispersion. An amount of the cationic polymer to be added is preferably in the range of 1 to 10% by weight based on the amount of the fumed silica.

Next, the wet process silica which can be used in the present invention is explained. The wet process silica to be used in the present invention is a precipitation method silica or a gel method silica. These silica powders before pulverization preferably have an average primary particle size of 50 nm or less, more preferably those having an average primary particle size of 3 to 40 nm and an average agglomerated particle size (secondary particle size) of 5 to 50 μm. In the present invention, these wet process silica are pulverized in an aqueous medium to an average secondary particle size of 500 nm or less, preferably 10 to 300 nm by using, for example, a media mill such as a ball mill, a beads mill, a sand grinder, etc., a pressure type dispersing device such as a high-pressure homogenizer, an ultra high-pressure homogenizer, etc., an ultrasonic wave dispersing device, and a thin-film spin type dispersing device, etc., and used. The above-mentioned pulverization is preferably carried out in the presence of a cationic polymer. The cationic polymer can be used the same as those used for dispersing the fumed silica.

The wet process silica prepared by the general method has an average agglomerated particle size of 1 μm or more, so that it is used by subjecting to fine pulverization. To make an average secondary particle size of said wet process silica 500 nm or less, a wet dispersing method in which silica dispersed in an aqueous medium is mechanically pulverized can be preferably used as the pulverization method. At this time, precipitation method silica having an oil absorption amount of 210 ml/100 g or less and an average agglomerated particle size of 5 μm or more is preferably used since increase in initial viscosity of the dispersion can be controlled, dispersion with a high concentration can be realized and pulverization and dispersion efficiencies are improved so that the particles can be pulverized finer. Productivity of the printing paper is also improved by using a dispersion with a high concentration. The oil absorption amount can be measured according to the description of JIS K-5101.

Wet process silica to be used in the ink-receptive layer A and the ink-receptive layer B of the present invention is preferably precipitation method silica. As mentioned above, the secondary particles of the precipitation method silica are gently agglomerated particles, so that they are suitable for pulverization.

Also, as the inorganic fine particles having an average secondary particle size of 500 nm or less contained in the ink-receptive layer A and the ink-receptive layer B, alumina or alumina hydrate can be suitably used. Alumina or alumina hydrate is aluminum oxide or its hydrate, which may be either crystalline or non-crystalline, and those having a form of amorphous, spherical, platy, etc., can be used. Either of which may be used or both may be used in combination.

As alumina oxide which can be used in the present invention, γ-alumina which is a γ type crystal of aluminum oxide is preferred, and above all, δ group crystal is preferred. It is possible to minimize the primary particle of γ-alumina to 10 nm or so, and in general, those in which secondary particle crystals having several thousands to several ten-thousands nm are dispersed by ultrasonic wave or by a high-pressure homogenizer, a counter collision type jet pulverizer, etc., to have an average secondary particle size of 500 nm or less, preferably 50 to 300 nm or so can be used.

Alumina hydrate which can be used in the present invention is represented by the structural formula of $Al_2O_3.nH_2O$ (n=1 to 3). Alumina hydrate can be obtained by the conventionally known preparation method such as hydrolysis of aluminum alkoxide such as aluminum isopropoxide, etc., neutralization of an aluminum salt by an alkali, hydrolysis of aluminate, etc. An average secondary particle size of alumina hydrate to be used in the present invention is 500 nm or less, and preferably 10 to 300 nm.

Alumina and alumina hydrate to be preferably used in the present invention are those in which they are dispersed to have an average secondary particle size of 500 nm or less by using a conventionally known dispersing agent such as acetic acid, lactic acid, formic acid, methanesulfonic acid, hydrochloric acid, nitric acid, etc.

The ink-receptive layer A and the ink-receptive layer B of the present invention preferably contain a hydrophilic binder for the purpose of maintaining characteristics as a film, and obtaining high transparency and high permeability of ink. Such a hydrophilic binder to be used may be mentioned a polyvinyl alcohol, polyethylene glycol, starch, dextrin, carboxymethylcellulose, polyvinyl pyrrolidone, polyacrylic acid ester or a derivative thereof, and preferred hydrophilic binder is a completely or partially saponified polyvinyl alcohol. Among the polyvinyl alcohol, preferred are a partially saponified material with a saponification degree of 80% or more or a completely saponified material. An average polymerization degree of the polyvinyl alcohol is preferably 500 to 5000.

A weight ratio of the hydrophilic binder to the inorganic fine particles having an average secondary particle size of 500 nm or less in the ink-receptive layer A and the ink-receptive layer B is preferably in the range of 5 to 50% by weight.

Further, in the ink jet recording material of the present invention, it is preferred that a ratio of an amount (weight) of the hydrophilic binder based on a total amount (weight) of the inorganic fine particles having an average secondary particle size of 500 nm or less and the pearlescent pigment contained in the ink-receptive layer A is larger than a ratio of an amount (weight) of the hydrophilic binder based on an amount (weight) of the inorganic fine particles having an average secondary particle size of 500 nm or less contained in the ink-receptive layer B, and the said ratio of the ink-receptive layer A is to be made 0.4 or less. According to this, an ink-jet recording material controlled in powder dropping at the time of cutting can be obtained. The said ratio of the ink-receptive layer B is preferably in the range of 0.05 to 0.3, more preferably in the range of 0.05 to 0.25. The said ratio of the ink-receptive layer A is 0.4 or less, and preferably larger than 0.05.

Here, an amount of the pearlescent pigment to be added to the ink-receptive layer A is particularly preferably in the range of 3 to 24% by weight based on the amount of the solid component of the inorganic fine particles having an average secondary particle size of 500 nm or less. According to this, an ink-jet recording material more controlled in powder dropping at the time of cutting can be obtained.

In the present invention, a dry coated amount of the ink-receptive layer A is preferably 60% by weight or less based on the coated amount of the solid component of whole ink-receptive layers, more preferably 15 to 50% by weight. Also, the coated amount of the solid component of whole ink-receptive layers of the present invention is preferably 10 to 60 $g/m^2$, and when the support is a resin-coated paper, it is preferably 20 to 60 $g/m^2$.

In the present invention, in the ink-receptive layer A and the ink-receptive layer B, it is preferred to contain a film-hardening agent in combination with a hydrophilic binder. Specific examples of the film-hardening agent may be mentioned an aldehyde compound such as formaldehyde and glutaraldehyde, a ketone compound such as diacetyl and chloropentanedione, bis(2-chloroethylurea), 2-hydroxy-4,6-dichloro-1,3,5-triazine, a compound having a reactive halogen as disclosed in U.S. Pat. No. 3,288,775, divinylsulfone, a compound having a reactive olefin as disclosed in U.S. Pat. No. 3,635,718, an N-methylol compound as disclosed in U.S. Pat. No. 2,732,316, an isocyanate compound as disclosed in U.S. Pat. No. 3,103,437, an aziridine compound as disclosed in U.S. Pat. No. 3,017,280 and No. 2,983,611, a carbodiimide type compound as disclosed in U.S. Pat. No. 3,100,704, an epoxy compound as disclosed in U.S. Pat. No. 3,091,537, a halogen carboxyaldehyde compound such as mucochloric acid, a dioxane derivative such as dihydroxydioxane, an inorganic hardening agent such as chromium alum, zirconium sulfate, boric acid and a borate, and they may be used singly or in combination of two or more. Among these, boric acid or a borate is particularly preferred. An amount of the film-hardening agent is preferably 0.1 to 40% by weight based on the amount of the hydrophilic binder forming the ink-receptive layer, more preferably 0.5 to 30% by weight.

In the ink-receptive layer A and the ink-receptive layer B of the present invention, the same cationic polymer as those to be used for cationization of the above-mentioned amorphous synthetic silica may be further used as an additive.

The ink-receptive layer A and the ink-receptive layer B of the present invention may contain a water-soluble polyvalent metal compound for the purpose of improving water-resistance, etc. The water-soluble polyvalent metal compound may be preferably utilized a water-soluble aluminum compound and a water-soluble zirconium compound.

The water-soluble zirconium compound to be used in the present invention may be mentioned zirconium acetate, zirconium nitrate, basic zirconium carbonate, zirconium hydroxide, ammonium zirconium carbonate, potassium zirconium carbonate, zirconium sulfate, zirconium fluoride, zirconium chloride, zirconium chloride octahydrate, zirconium oxychloride, zirconium hydroxychloride, etc. Among these water-soluble zirconium compounds, zirconium acetate (zirconyl acetate) and zirconium oxychloride are preferred.

The water-soluble aluminum compound has been known, for example, aluminum chloride or its hydrate, aluminum sulfate or its hydrate, ammonium alum, etc. as the inorganic salts. Moreover, a basic polyaluminum hydroxide compound which is an inorganic aluminum-containing cationic polymer has been known.

Among these water-soluble aluminum compounds, those which can be stably added to the coating solution for forming the ink-receptive layers A and B are preferred, and a basic polyaluminum hydroxide compound is preferably used. A main component of the compound is shown by the following formula 1, 2 or 3, and is a water-soluble polyaluminum hydroxide containing a polynuclear condensed ion which is a basic and high molecular weight, for example, $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

$$[Al_2(OH)_nCl_{6-n}]_m \quad \text{formula 1}$$

$$[Al(OH)_3]_nAlCl_3 \quad \text{formula 2}$$

$$Al_n(OH)_mCl_{(3n-m)}\ 0<m<3n \quad \text{formula 3}$$

These materials are commercially available from Taki Chemical, K.K. under the trade name of polyaluminum chloride (PAC) as a water treatment agent, from Asada Chemical K.K. under the trade name of polyaluminum hydroxide (Patio), from K.K. Riken Green under the trade name of Pyurakemu WT and other manufacturers with the same objects whereby various kinds of different grades can be easily obtained. In the present invention, these commercially available products can be used as such.

An amount of the above-mentioned water-soluble polyvalent metal compound to be contained is preferably in the range of 0.1 to 10% by weight based on the amount of the inorganic fine particles having an average secondary particle size of 500 nm or less contained in the ink-receptive layer A and the ink-receptive layer B.

To the ink-receptive layer A and the ink-receptive layer B, various kinds of conventionally known additives such as a coloring dye, a coloring pigment, a UV absorber, an antioxidant, a dispersant of the pigment, an antifoaming agent, a leveling agent, an antiseptic agent, a fluorescent brightener, a viscosity stabilizer, a pH buffer, etc. may be further added. Also, a pH of the coating solution for the ink-receptive layer of the present invention is preferably in the range of 3.3 to 6.5, more preferably in the range of 3.5 to 5.5.

Also, preservability of the material after printing can be improved by adding a thioether compound, carbohydrazide and derivatives thereof to the ink-receptive layer A and the ink-receptive layer B.

The carbohydrazide derivative to be used in the present invention may be a compound having one or two or more of the structure in the same molecule, or a polymer having the structure in the main chain or the side chain of the molecule.

In the thioether compound to be used in the present invention, there may be mentioned an aromatic thioether compound in which aromatic groups are bonded to the both sides of the sulfur atom, an aliphatic thioether compound in which alkyl groups are present at the both ends sandwiching the sulfur atom, etc. Among these, an aliphatic thioether compound having a hydrophilic group(s) is particularly preferred.

These compounds can be synthesized according to the already known synthetic method or by referring to the synthetic methods as disclosed in JP 2002-321447A or JP 2003-48372A. With regard to a part of the compounds, a commercially available chemical product can be used as such.

In the present invention, the ink-receptive layer is preferably provided by coating a coating solution using water as a main medium on a support and drying. Effects of the present invention can be obtained even when a coating method of the ink-receptive layer may be either a step-wise coating method in which a layer is coated each one layer (for example, a blade coater, an air knife coater, a roll coater, a bar coater, a gravure coater, a reverse coater, etc.), or a multilayer-simultaneously coating method (for example, a slide bead coater, a slide curtain coater, etc.). However, in the viewpoint of production efficiency, the multilayer-simultaneously coating method is preferably used.

As a support for an ink jet recording material of the present invention, there may be mentioned an uncoated paper, art paper, coated paper, cast-coated paper, or a resin-coated paper at least one surface of the base paper is coated with a resin, etc., and a resin-coated paper is preferred in the viewpoint of glossiness, and in particular, a polyolefin resin-coated paper at least one surface (the surface on which the ink-receptive layer is to be provided) of the base paper is coated by a polyolefin resin layer is preferred. Also, even when a resin film is used as a support, an ink jet recording material excellent in ink absorbability, glossiness, image clarity and coloring property can be obtained. A thickness of these supports used is generally 50 to 300 preferably 80 to 260 μm.

The polyolefin resin-coated paper support (hereinafter referred to polyolefin resin-coated paper) to be preferably used in the present invention is explained in detail. The polyolefin resin-coated paper to be used in the present invention is not particularly limited in its moisture content, and it is preferably in the range of 5.0 to 9.0% by weight in the viewpoint of preventing curl, and more preferably in the range of 6.0 to 9.0% by weight. The moisture content of the polyolefin resin-coated paper can be measured by using an optional moisture content measurement method. For example, it may be used an infrared moisture meter, bone-dry weight measurement method, permittivity measurement method, Karl-Fischer's method, etc.

A base paper constituting the polyolefin resin-coated paper is not particularly limited, and generally used paper can be used, and preferably a smooth raw paper, for example, to be used for the support of photography. A pulp constituting the base paper may be mentioned natural pulp, regenerated pulp, synthetic pulp, each singly or in combination of two or more in admixture. In the base paper, an additive to be generally used in paper-making such as a sizing agent, a strengthening additive of paper, a filler, an antistatic agent, a fluorescent brightener, and dye, etc., is formulated.

Moreover, a surface sizing agent, a surface strengthening additive of paper, a fluorescent brightener, an antistatic agent, dye, anchoring agent, etc., may be coated on the surface.

A thickness of the base paper is not particularly limited, but those having good surface smoothness are preferred, which are prepared by applying a pressure to paper during paper making or by calendering after paper making to compress the paper, and the basis weight is preferably 30 to 250 g/m$^2$.

The polyolefin resin to be used for coating the base paper may be mentioned a homopolymer of an olefin such as a low-density polyethylene, high-density polyethylene, polypropylene, polybutene, polypentene, etc., a copolymer comprising two or more olefins such as an ethylene-propylene copolymer, etc., and a mixture thereof, and those having various densities, melt viscosity indexes (Melt Index) may be used alone or in combination as a mixture.

Also, to the resin of the polyolefin resin-coated paper, it is preferred to add various kinds of additives such as white pigments such as titanium dioxide, zinc oxide, talc, calcium carbonate, etc., aliphatic acid amides such as stearic acid amide, arachidic acid amide, etc., aliphatic acid metal salts such as zinc stearate, calcium stearate, aluminum stearate, magnesium stearate, etc., antioxidants such as a hindered phenol series compound, etc., blue pigments or dyes such as cobalt blue, ultramarine, Cecilian blue, phthalocyanine blue, etc., magenta pigments or dyes such as cobalt violet, fast violet, manganese violet, etc., a fluorescent brightener, a UV absorber, etc., in an optional combination.

As a main preparation method of the polyolefin resin-coated paper, there may be mentioned a so-called extrusion coating method in which a polyolefin resin is casting on the running base paper in the state of melting by heating, whereby the both surfaces of the base paper are coated by the resin. It is also preferred to carry out an activation treatment such as a corona discharge treatment, a flame treatment, etc., to the base paper before coating the resin to the base paper. A thickness of the resin coating layer is suitably 5 to 50 μm.

On the side of the support to be used in the present invention to which the ink-receptive layer is to be provided by coating, a subbing layer is preferably provided. The subbing layer is previously coated on the surface of the support and dried before providing the ink-receptive layer by coating. The subbing layer mainly contains a film-formable water-soluble polymer or a polymer latex, etc. It is preferably a water-soluble polymer such as gelatin, polyvinyl alcohol, polyvinyl pyrrolidone, water-soluble cellulose, etc., more preferably gelatin. An amount of these water-soluble polymers to be attached is preferably 10 to 500 mg/m$^2$, more preferably 20 to 300 mg/m$^2$. The subbing layer further preferably contains a surfactant or a film-hardening agent. By providing a subbing layer to the support, it effectively acts to prevent from causing crack at the time of coating the ink-receptive layer, whereby uniform coating surface can be obtained.

At the opposite side of the support to the side having an ink absorbability of the ink jet recording material according to the present invention, various kinds of backing layer(s) may be provided for the purpose of preventing curl, preventing adhesion when the materials are overlapped immediately after printing or preventing ink transfer more effectively. Also, on the surface of the side having an ink absorbability of the ink jet recording material according to the present invention, in addition to the above-mentioned ink-receptive layer A, ink-receptive layer B and a subbing layer, a layer containing colloidal silica, etc., may be provided at the position apart from the support than the ink-receptive layer B for the purpose of improving scratching resistance. Moreover, for the purpose of more improving ink absorption, a layer mainly containing inorganic fine particles or a layer mainly containing a hydrophilic resin may be provided at the side nearer to the support than the ink-receptive layer A.

EXAMPLES

In the following, the present invention will be explained in more detail by referring to Examples, but the contents of the present invention are not limited by the Examples. Incidentally, all part and % are weight basis otherwise specifically mentioned.

Example 1

Preparation of Polyolefin Resin-Coated Paper 1

A mixture of a bleached kraft pulp of hardwood (LBKP) and a bleached sulfite pulp of hardwood (LBSP) with a ratio of 1:1 was subjected to beating until it becomes 300 ml by the Canadian Standard Freeness to prepare a pulp slurry. To the slurry were added alkyl ketene dimer in an amount of 0.5% based on the amount of the pulp as a sizing agent, polyacrylamide in an amount of 1.0% based on the same as a strengthening additive of paper, cationic starch in an amount of 2.0% based on the same, and a polyamide epichlorohydrin resin in an amount of 0.5% based on the same, and the mixture was diluted with water to prepare a slurry with a concentration of 0.2%. This slurry was made paper by a fourdrinier paper machine to have a basis weight of 170 g/m$^2$, dried and subjected to moisture conditioning to prepare a base paper for a polyolefin resin-coated paper. A polyethylene resin composition in which 10% of anatase type titanium dioxide had been uniformly dispersed based on a resin of a low density polyethylene having a density of 0.918 g/cm$^3$ was melted at 320° C. and the melted resin composition was subjected to extrusion coating on a surface of the above-mentioned base paper with a thickness of 35 μm and subjected to extrusion coating by using a cooling roller subjected to slightly roughening treatment to make a front surface. On the other surface of the base paper, a blended resin composition comprising 70 parts of a high density polyethylene resin having a density of 0.962 g/cm$^3$ and 30 parts of a low density polyethylene resin having a density of 0.918 g/cm$^3$ was melted similarly at 320° C. and the melted resin composition was subjected to extrusion coating with a thickness of 30 μm and subjected to extrusion coating by using a cooling roller subjected to roughening treatment to make a back surface.

Onto the front surface of the above-mentioned polyolefin resin-coated paper was subjected to a high frequency corona discharge treatment, and then, a subbing layer having the composition mentioned below was coated thereon to have the gelatin amount of 50 mg/m$^2$ and dried to prepare a support.

<Subbing Layer>

| | |
|---|---|
| Lime-treated gelatin | 100 parts |
| 2-Ethylhexyl sulfosuccinate | 2 parts |
| Chromium alum | 10 parts |

Onto the surface of the polyolefin resin-coated paper thus prepared at which the subbing layer has been provided, double-layer coating was carried out by a slide bead coater with Ink-receptive layer coating solution 1 having the following composition as the ink-receptive layer A, and Ink-receptive layer coating solution 2 having the following composition as the ink-receptive layer B. A dry coating amount of Ink-receptive layer coating solution 1 was 8.3 g/m$^2$, and a dry coating amount of Ink-receptive layer coating solution 2 was 16.7 g/m$^2$. The drying conditions after coating were cooling at 10° C. for 20 seconds, and then, blowing hot air at 30 to 55° C. to carry out drying.

<Preparation of Fumed Silica Dispersion 1>

To water were added 4 parts of dimethyl diallyl ammonium chloride homopolymer (weight average molecular weight: 9000) and 100 parts of fumed silica (average primary particle size: 7 nm, specific surface area by the BET method: 300 m$^2$/g) to prepare a provisional dispersion, and then, the mixture was treated by a high-pressure homogenizer to prepare Fumed silica dispersion having a concentration of the solid component of 20%. An average secondary particle size of the fumed silica was 135 nm.

<Preparation of Pearlescent Pigment Dispersion 1>

To water was added a pearlescent pigment (available from NIHONKOKEN Co., Ltd., MM-100R) to prepare a provisional dispersion, and then, the mixture was stirred by a propeller blade stirrer at 700 rpm for 5 minutes to prepare Pearlescent pigment dispersion 1 having a concentration of the solid component of 25%.

<Ink-Receptive Layer Coating Solution 1>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 26.5 parts |

Concentration of solid components in coating solution: 13.9%

<Ink-Receptive Layer Coating Solution 2>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |

Concentration of solid components in coating solution: 12.8%

Example 2

An ink jet recording material of Example 2 was obtained in the same manner as in Example 1 except for changing Pearlescent pigment dispersion 1 of Example 1 to the following mentioned Pearlescent pigment dispersion 2.

<Preparation of Pearlescent Pigment Dispersion 2>

To water was added a pearlescent pigment (available from NIHONKOKEN Co., Ltd., ME-100R) to prepare a provisional dispersion, and then, the mixture was stirred by a propeller blade stirrer at 700 rpm for 5 minutes to prepare Pearlescent pigment dispersion 2 having a concentration of the solid component of 25%.

Example 3

An ink jet recording material of Example 3 was obtained in the same manner as in Example 1 except for changing Pearlescent pigment dispersion 1 of Example 1 to the following mentioned Pearlescent pigment dispersion 3.

<Preparation of Pearlescent Pigment Dispersion 3>

To water was added a pearlescent pigment (available from MERCK & CO., Iriodin 123 Bright Lustre Satin) to prepare a provisional dispersion, and then, the mixture was stirred by a propeller blade stirrer at 700 rpm for 5 minutes to prepare Pearlescent pigment dispersion 3 having a concentration of the solid component of 25%.

Example 4

An ink jet recording material of Example 4 was obtained in the same manner as in Example 1 except for changing Pearlescent pigment dispersion 1 of Example 1 to the following mentioned Pearlescent pigment dispersion 4.

<Preparation of Pearlescent Pigment Dispersion 4>

To water was added a pearlescent pigment (available from MERCK & CO., Xirallic T50-10 Crystal Silver) to prepare a provisional dispersion, and then, the mixture was stirred by a propeller blade stirrer at 700 rpm for 5 minutes to prepare Pearlescent pigment dispersion 4 having a concentration of the solid component of 25%.

Example 5

Onto the surface of the polyolefin resin-coated paper prepared in the same manner as in Example 1 at which a subbing layer has been provided, double-layer coating was carried out by a slide bead coater, with Ink-receptive layer coating solution 3 having the following composition as the ink-receptive layer A, and Ink-receptive layer coating solution 4 having the following composition as the ink-receptive layer B. A dry coating amount of Ink-receptive layer coating solution 3 was 13.8 g/m$^2$, and a dry coating amount of Ink-receptive layer coating solution 4 was 26.2 g/m$^2$. The drying conditions after coating were cooling at 10° C. for 20 seconds, and then, blowing hot air at 30 to 55° C. to carry out drying.

<Alumina Hydrate Dispersion 1>

To water was provisionally added nitric acid as a peptizer so as to be 20 mmol based on 100 g of alumina hydrate solid component, and under stirring the mixture by a dispersing device (manufactured by PRIMIX Corporation, HIVIS DISPER MIX), pseudo boehmite powder (DISPERAL HP14, available from Sasol) which is alumina hydrate was added to the mixture, and stirring was further continued for 60 minutes to obtain an alumina hydrate dispersion having a concentration of the solid component of 25%. An average secondary particle size of the alumina hydrate was 160 nm.

<Ink-Receptive Layer Coating Solution 3>

| | |
|---|---|
| Alumina hydrate dispersion 1 (as a solid content of alumina hydrate) | 100 parts |
| Boric acid | 0.5 part |
| Polyvinyl alcohol (Saponification degree: 88%, average polymerization degree: 3500) | 10 parts |
| Pearlescent pigment dispersion 1 (as a solid content of pearlescent pigment) | 12.5 parts |

Concentration of solid components in coating solution: 18.5%

<Ink-Receptive Layer Coating Solution 4>

| | |
|---|---|
| Alumina hydrate dispersion 1 (as a solid content of alumina hydrate) | 100 parts |
| Boric acid | 0.5 part |
| Polyvinyl alcohol (Saponification degree: 88%, average polymerization degree: 3500) | 10 parts |

Concentration of solid components in coating solution: 18.0%

Example 6

An ink jet recording material of Example 6 was obtained in the same manner as in Example 1 except for changing Ink-receptive layer coating solution 1 of Example 1 to the following mentioned Ink-receptive layer coating solution 5.

<Ink-Receptive Layer Coating Solution 5>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 0.8 part |

Concentration of solid components in coating solution: 12.8%

Example 7

An ink jet recording material of Example 7 was obtained in the same manner as in Example 1 except for changing Ink-receptive layer coating solution 1 of Example 1 to the following mentioned Ink-receptive layer coating solution 6.

<Ink-Receptive Layer Coating Solution 6>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 10 parts |

Concentration of solid components in coating solution: 13.2%

Example 8

An ink jet recording material of Example 8 was obtained in the same manner as in Example 1 except for changing Ink-receptive layer coating solution 1 of Example 1 to the following mentioned Ink-receptive layer coating solution 7.

<Ink-Receptive Layer Coating Solution 7>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 20 parts |

Concentration of solid components in coating solution: 13.7%

Example 9

An ink jet recording material of Example 9 was obtained in the same manner as in Example 1 except for changing Ink-receptive layer coating solution 1 of Example 1 to the following mentioned Ink-receptive layer coating solution 8.

<Ink-Receptive Layer Coating Solution 8>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 30 parts |

Concentration of solid components in coating solution: 14.1%

Example 10

An ink jet recording material of Example 10 was obtained in the same manner as in Example 1 except for changing Ink-receptive layer coating solution 1 of Example 1 to the following mentioned Ink-receptive layer coating solution 9.

<Ink-Receptive Layer Coating Solution 9>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 40 parts |

Concentration of solid components in coating solution: 14.4%

Comparative Example 1

An ink jet recording material of Comparative example 1 was obtained in the same manner as in Example 1 except for changing the ink-receptive layer A and the ink-receptive layer B comprising Ink-receptive layer coating solution 1 and Ink-receptive layer coating solution 2 of Example 1 to the following mentioned Ink-receptive layer coating solution 10 which was coated so that a dry coating amount of 25 g/m$^2$, whereby the ink-receptive layer was provided with a single layer.

<Ink-receptive layer coating solution 10>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 7.7 parts |

Concentration of solid components in coating solution: 13.1%

Comparative Example 2

An ink jet recording material of Comparative example 2 was obtained in the same manner as in Example 1 except for changing the coating solution for the ink-receptive layer A of Example 1 to Ink-receptive layer coating solution 2 and its dry coating amount was changed to 18.7 g/m$^2$, and changing the coating solution for the ink-receptive layer B to Ink-receptive layer coating solution 1 and its dry coating amount was changed to 6.3 g/m$^2$.

Comparative Example 3

An ink jet recording material of Comparative example 3 was obtained in the same manner as in Example 1 except for providing an undercoat layer on a subbing layer by coating Pearlescent pigment coating solution 1 having the following composition so that a dry coating amount became 2.6 g/m$^2$, and then, coating Ink-receptive layer coating solution 2 so that a dry coating amount thereof became 25 g/m$^2$ in place of the ink-receptive layer A and the ink-receptive layer B comprising Ink-receptive layer coating solution 1 and Ink-receptive layer coating solution 2, respectively.

<Pearlescent Pigment Coating Solution 1>

| | |
|---|---|
| Polyvinyl alcohol (Saponification degree: 88%, average polymerization degree: 3500) | 100 parts |
| Pearlescent pigment dispersion 1 (as a solid content of pearlescent pigment) | 9.2 parts |

Concentration of solid components in coating solution: 12.6%

Comparative Example 4

An ink jet recording material of Comparative example 4 was obtained in the same manner as in Example 1 except for changing Ink-receptive layer coating solution 1 of Example 1 to Ink-receptive layer coating solution 11 having the following mentioned composition.

<Ink-Receptive Layer Coating Solution 11>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Matting agent (wet process silica available from MIZUSAWA INDUSTRIAL CHEMICALS, LTD., MIZUKASIL P78A, average particle diameter 3 μm) | 1 part |

Concentration of solid components in coating solution: 12.8%

Comparative Example 5

An ink jet recording material of Comparative example 5 was obtained in the same manner as in Example 1 except for changing the polyolefin resin-coated paper 1 of Example 1 to the polyolefin resin-coated paper 2 having the following composition, and further coating Ink-receptive layer coating solution 2 so that a dry coating amount thereof became 25 g/m$^2$ to provide an ink-receptive layer with a single layer, in place of the ink-receptive layer A and the ink-receptive layer B comprising Ink-receptive layer coating solution 1 and Ink-receptive layer coating solution 2, respectively.

<Preparation of Polyolefin Resin-Coated Paper 2>

A polyethylene resin composition in which 10% of anatase type titanium dioxide and 4.5% of pearlescent pigment (available from NIHONKOKEN Co., Ltd., MM-100R) had been uniformly dispersed based on a low density polyethylene having a density of 0.918 g/cm$^3$ was melted at 320° C. and the melted resin composition was subjected to extrusion coating on a surface of the base paper prepared in the same manner as in the polyolefin resin-coated paper 1 and subjected to extrusion coating by using a cooling roller subjected to slightly roughening treatment to make a front surface. On the other surface of the base paper, in the same manner as in the polyolefin resin-coated paper 1, a blended resin composition comprising 70 parts of a high density polyethylene resin having a density of 0.962 g/cm$^3$ and 30 parts of a low density polyethylene resin having a density of 0.918 g/cm$^3$ was melted similarly at 320° C. and the melted resin composition was subjected to extrusion coating with a thickness of 30 μm and subjected to extrusion coating by using a cooling roller subjected to roughening treatment to make a back surface.

Comparative Example 6

An ink jet recording material of Comparative example 6 was obtained in the same manner as in Example 1 except for coating Ink-receptive layer coating solution 2 so that a dry coating amount thereof became 25 g/m$^2$ to provide an ink-receptive layer with a single layer, in place of the ink-receptive layer A and the ink-receptive layer B comprising Ink-receptive layer coating solution 1 and Ink-receptive layer coating solution 2 of Example 1, respectively.

With regard to the ink jet recording materials prepared as mentioned above, the following evaluations were carried out. The results are shown in Table 1.

<Ink Absorbability>

By using an ink jet printer (manufactured by SEIKO EPSON Corporation, G860), solid printing was carried out with red, blue, green and black, a PPC paper was overlapped and slightly pressed to contact with the printed portion immediately after the printing, and a degree of an amount of ink transferred to the PPC paper was observed with naked eyes. Evaluation was carried out by the following mentioned criteria.

○: Not transferred.

Δ: Slightly transferred.

X: Transfer can be clearly observed at the printed portion.

<Feel of Surface Unevenness>

A coating surface of the coated and dried ink-receptive layer was observed with naked eyes, and evaluated by the following criteria.

○: Feel of surface unevenness of the base paper is not remarkable.

X: Feel of surface unevenness of the base paper is remarkable.

<Glossiness>

Glossiness of the recording material before printing was observed with inclined light, and evaluation was carried out by the following mentioned criteria.

◎: It possesses high glossiness superior to that of a color photography.

○: It possesses high glossiness as that of a color photography.
X: No glossiness.
<Image Clarity>

Onto an ink-receptive layer of a coated and dried ink jet recording material was reflected a fluorescent light, and the reflected image was observed with naked eyes, and evaluated by the following criteria.

○: Reflected image of the fluorescent light can be clearly confirmed.
Δ: Reflected image of the fluorescent light can be confirmed.
X: Reflected image of the fluorescent light is blurred.
X X: Reflected image of the fluorescent light is markedly blurred.
<Coloring Property>

By using a commercially available ink jet printer (manufactured by Seiko Epson Co., G860), a degree of dullness of a composite black comprising a mixed color of C, M and Y, and a coloring density of each color of C, M and Y were observed with naked eyes. Evaluation was carried out by the following mentioned criteria.

○: No dullness, and coloring property is good.
Δ: Dullness can be slightly admitted but good.
X: Dullness can be admitted, and coloring property is low.
X X: Strong dullness can be admitted, and coloring property is low.

TABLE 1

| Sample | Ink absorb-ability | Feel of surface unevenness | Glossiness | Image clarity | Coloring property |
|---|---|---|---|---|---|
| Example 1 | ○ | ○ | ◎ | ○ | ○ |
| Example 2 | ○ | ○ | ◎ | ○ | ○ |
| Example 3 | ○ | ○ | ◎ | ○ | ○ |
| Example 4 | ○ | ○ | ◎ | ○ | ○ |
| Example 5 | ○ | ○ | ◎ | ○ | ○ |
| Example 6 | ○ | ○ | ◎ | Δ | Δ |
| Example 7 | ○ | ○ | ○ | ○ | ○ |
| Example 8 | ○ | ○ | ◎ | ○ | ○ |
| Example 9 | ○ | ○ | ◎ | ○ | ○ |
| Example 10 | ○ | ○ | ◎ | Δ | ○ |
| Comparative example 1 | ○ | ○ | ◎ | X | X |
| Comparative example 2 | ○ | ○ | ◎ | X | X X |
| Comparative example 3 | ○ | ○ | X | X X | ○ |
| Comparative example 4 | ○ | ○ | X | X X | X |
| Comparative example 5 | ○ | ○ | ◎ | X | ○ |
| Comparative example 6 | ○ | X | ○ | ○ | ○ |

From the above-mentioned results, the feeling of the surface unevenness is canceled in the ink jet recording materials of the present invention without impairing glossiness, image clarity and coloring property. Comparative example 1 comprises a single layer in which the ink-receptive layer contains a pearlescent pigment so that it gave the results that image clarity and coloring property were low. Comparative example 2 comprises a material in which the ink-receptive layer B contains a pearlescent pigment so that it gave the results that image clarity and coloring property were low. Comparative example 3 comprises a material in which the undercoat layer contains a pearlescent pigment so that it gave the results that glossiness and image clarity were low. Comparative example 4 comprises a material in which the ink-receptive layer A which is a layer nearer to the support contains a matting agent, so that it gave the results that glossiness, image clarity and coloring property were low. Comparative example 5 comprises a material in which the polyolefin resin-coated paper contains a pearlescent pigment so that it gave the results that image clarity was low. Comparative example 6 comprises a material in which no pearlescent pigment is contained so that the feel of surface unevenness was not canceled.

Example 11

An ink jet recording material of Example 11 was obtained in the same manner as in Example 1 except for changing Ink-receptive layer coating solution 1 of Example 1 to Ink-receptive layer coating solution 12 having the following composition. A ratio of an amount of the hydrophilic binder based on the total amount of the inorganic fine particles and the pearlescent pigment contained in the ink-receptive layer A was 0.38, and a ratio of an amount of the hydrophilic binder based on the inorganic fine particles contained in the ink-receptive layer B was 0.23.

<Ink-Receptive Layer Coating Solution 12>

| | |
|---|---|
| Fumed silica dispersion 1 (as a solid content of fumed silica) | 100 parts |
| Boric acid | 6 parts |
| Polyvinyl alcohol (Saponification degree: 88%, average polymerization degree: 3500) | 45 parts |
| Pearlescent pigment dispersion 1 (as a solid content of pearlescent pigment) | 18 parts |

Concentration of solid components in coating solution: 13.5%

Example 12

An ink jet recording material of Example 12 was obtained in the same manner as in Example 11 except for changing Pearlescent pigment dispersion 1 of Example 11 to the following Pearlescent pigment dispersion 5. A ratio of an amount of the hydrophilic binder based on the total amount of the inorganic fine particles and the pearlescent pigment contained in the ink-receptive layer A was 0.38, and a ratio of an amount of the hydrophilic binder based on the inorganic fine particles contained in the ink-receptive layer B was 0.23.

<Preparation of Pearlescent Pigment Dispersion 5>

To water was added a pearlescent pigment (available from NIHONKOKEN Co., Ltd., MB-100RF) to prepare a provisional dispersion, and then, the mixture was stirred by a propeller blade stirrer at 700 rpm for 5 minutes to prepare Pearlescent pigment dispersion 5 having a concentration of the solid component of 25%.

Example 13

An ink jet recording material of Example 13 was obtained in the same manner as in Example 11 except for changing Pearlescent pigment dispersion 1 of Example 11 to Pearlescent pigment dispersion 2. A ratio of an amount of the hydrophilic binder based on the total amount of the inorganic fine particles and the pearlescent pigment contained in the ink-receptive layer A was 0.38, and a ratio of an amount of the hydrophilic binder based on the inorganic fine particles contained in the ink-receptive layer B was 0.23.

Example 14

An ink jet recording material of Example 14 was obtained in the same manner as in Example 11 except for changing Pearlescent pigment dispersion 1 of Example 11 to Pearlescent pigment dispersion 3. A ratio of an amount of the hydrophilic binder based on the total amount of the inorganic fine particles and the pearlescent pigment contained in the ink-receptive layer A was 0.38, and a ratio of an amount of the hydrophilic binder based on the inorganic fine particles contained in the ink-receptive layer B was 0.23.

Example 15

An ink jet recording material of Example 15 was obtained in the same manner as in Example 11 except for changing Pearlescent pigment dispersion 1 of Example 11 to Pearlescent pigment dispersion 4. A ratio of an amount of the hydrophilic binder based on the total amount of the inorganic fine particles and the pearlescent pigment contained in the ink-receptive layer A was 0.38, and a ratio of an amount of the hydrophilic binder based on the inorganic fine particles contained in the ink-receptive layer B was 0.23.

Example 16

An ink jet recording material of Example 16 was obtained in the same manner as in Example 5 except for changing Ink-receptive layer coating solution 3 of Example 5 to Ink-receptive layer coating solution 13 having the following composition. A ratio of an amount of the hydrophilic binder based on the total amount of the inorganic fine particles and the pearlescent pigment contained in the ink-receptive layer A was 0.18, and a ratio of an amount of the hydrophilic binder based on the inorganic fine particles contained in the ink-receptive layer B was 0.10.

<Ink-Receptive Layer Coating Solution 13>

| | |
|---|---|
| Alumina hydrate dispersion 1 (as a solid content of alumina hydrate) | 100 parts |
| Boric acid | 0.75 part |
| Polyvinyl alcohol (Saponification degree: 88%, average polymerization degree: 3500) | 20 parts |
| Pearlescent pigment dispersion 1 (as a solid content of pearlescent pigment) | 8.6 parts |

Concentration of solid components in coating solution: 17.5%

Example 17

An ink jet recording material of Example 17 was obtained in the same manner as in Example 1 except for changing Ink-receptive layer coating solution 1 of Example 1 to Ink-receptive layer coating solution 14 having the following composition. A ratio of an amount of the hydrophilic binder based on the total amount of the inorganic fine particles and the pearlescent pigment contained in the ink-receptive layer A was 0.25, and a ratio of an amount of the hydrophilic binder based on the inorganic fine particles contained in the ink-receptive layer B was 0.23.

<Ink-Receptive Layer Coating Solution 14>

| | |
|---|---|
| Fumed silica dispersion 1 (as a solid content of fumed silica) | 100 parts |
| Boric acid | 6 parts |
| Polyvinyl alcohol (Saponification degree: 88%, average polymerization degree: 3500) | 30 parts |
| Pearlescent pigment dispersion 1 (as a solid content of pearlescent pigment) | 18 parts |

Concentration of solid components in coating solution: 13.5%

Example 18

An ink jet recording material of Example 18 was obtained in the same manner as in Example 1 except for changing Ink-receptive layer coating solution 1 of Example 1 to Ink-receptive layer coating solution 15 having the following composition. A ratio of an amount of the hydrophilic binder based on the total amount of the inorganic fine particles and the pearlescent pigment contained in the ink-receptive layer A was 0.35, and a ratio of an amount of the hydrophilic binder based on the inorganic fine particles contained in the ink-receptive layer B was 0.23.

<Ink-Receptive Layer Coating Solution 15>

| | |
|---|---|
| Fumed silica dispersion 1 (as a solid content of fumed silica) | 100 parts |
| Boric acid | 6 parts |
| Polyvinyl alcohol (Saponification degree: 88%, average polymerization degree: 3500) | 45 parts |
| Pearlescent pigment dispersion 1 (as a solid content of pearlescent pigment) | 30 parts |

Concentration of solid components in coating solution: 13.5%

Example 19

An ink jet recording material of Example 19 was obtained in the same manner as in Example 1 except for changing Ink-receptive layer coating solution 1 of Example 1 to Ink-receptive layer coating solution 16 having the following composition. A ratio of an amount of the hydrophilic binder based on the total amount of the inorganic fine particles and the pearlescent pigment contained in the ink-receptive layer A was 0.19, and a ratio of an amount of the hydrophilic binder based on the inorganic fine particles contained in the ink-receptive layer B was 0.23.

<Ink-Receptive Layer Coating Solution 16>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 18 parts |

Concentration of solid components in coating solution: 13.5%

Example 20

An ink jet recording material of Example 20 was obtained in the same manner as in Example 1 except for changing Ink-receptive layer coating solution 1 of Example 1 to Ink-receptive layer coating solution 17 having the following composition. A ratio of an amount of the hydrophilic binder based on the total amount of the inorganic fine particles and the pearlescent pigment contained in the ink-receptive layer A was 0.42, and a ratio of an amount of the hydrophilic binder based on the inorganic fine particles contained in the ink-receptive layer B was 0.23.

<Ink-Receptive Layer Coating Solution 17>

| | |
|---|---|
| Fumed silica dispersion 1 (as a solid content of fumed silica) | 100 parts |
| Boric acid | 6 parts |
| Polyvinyl alcohol (Saponification degree: 88%, average polymerization degree: 3500) | 50 parts |
| Pearlescent pigment dispersion 1 (as a solid content of pearlescent pigment) | 18 parts |

Concentration of solid components in coating solution: 13.5%

Comparative Example 7

An ink jet recording material of Comparative example 7 was obtained in the same manner as in Example 1 except for coating Ink-receptive layer coating solution 18 mentioned below so that a dry coating amount thereof became 25 g/m$^2$ to provide an ink-receptive layer with a single layer, in place of the ink-receptive layer A and the ink-receptive layer B comprising Ink-receptive layer coating solution 1 and Ink-receptive layer coating solution 2 of Example 1, respectively.

<Ink-Receptive Layer Coating Solution 18>

| | |
|---|---|
| Fumed silica dispersion 1 (as a solid content of fumed silica) | 100 parts |
| Boric acid | 4 parts |
| Polyvinyl alcohol (Saponification degree: 88%, average polymerization degree: 3500) | 23 parts |
| Pearlescent pigment dispersion 1 (as a solid content of pearlescent pigment) | 5.5 parts |

Concentration of solid components in coating solution: 13.1%

Comparative Example 8

An ink jet recording material of Comparative example 8 was obtained in the same manner as in Example 11 except for changing the coating solution of the ink-receptive layer A in Example 11 to Ink-receptive layer coating solution 2 and making its dry coating amount 18.7 g/m$^2$, and changing the coating solution of the ink-receptive layer B to Ink-receptive layer coating solution 12 and making its dry coating amount 6.3 g/m$^2$.

With regard to the ink jet recording materials prepared as mentioned above, and materials of Example 1, Example 5, and Comparative example 3 to 6, the following evaluations were carried out. The results are shown in Table 2. Incidentally, in Example 1, a ratio of an amount of the hydrophilic binder based on the total amount of the inorganic fine particles and the pearlescent pigment contained in the ink-receptive layer A was 0.18, and a ratio of an amount of the hydrophilic binder based on the inorganic fine particles contained in the ink-receptive layer B was 0.23. In Example 5, a ratio of an amount of the hydrophilic binder based on the total amount of the inorganic fine particles and the pearlescent pigment contained in the ink-receptive layer A was 0.09, and a ratio of an amount of the hydrophilic binder based on the inorganic fine particles contained in the ink-receptive layer B was 0.10.

<Powder Dropping>

A4 size ink jet recording material was cut with an unused cutter knife to a shorter side direction to prepare 30 pieces of paper bundle, and powder dropping generated at the cut paper edges was observed with naked eyes, then, evaluation was carried out by the following mentioned criteria.

◎: Substantially no powder dropping was observed.
○: Powder dropping was slightly observed.
Δ: Powder dropping was observed.
X: Much powder dropping was observed.

<Ink Absorbability>

By using an ink jet printer (manufactured by Canon K.K., iP4500), solid printing was carried out with red, blue, green and black, a PPC paper was overlapped and slightly pressed to contact with the printed portion immediately after the printing, and a degree of an amount of ink transferred to the PPC paper was observed with naked eyes. Evaluation was carried out by the following mentioned criteria.

○: Not transferred.
Δ: Slightly transferred.
X: Transfer can be clearly observed at the printed portion.

<Feel of Surface Unevenness>

A coating surface of the coated and dried ink-receptive layer was observed with naked eyes, and evaluated by the following criteria.

○: Feel of surface unevenness of the base paper is not remarkable.
X: Feel of surface unevenness of the base paper is remarkable.

<Glossiness>

Glossiness of the recording material before printing was observed with inclined light, and evaluation was carried out by the following mentioned criteria.

◎: It possesses high glossiness superior to that of a color photography.
○: It possesses high glossiness as that of a color photography.
X: No glossiness.

<Image Clarity>

Onto an ink-receptive layer of a coated and dried ink jet recording material was reflected a fluorescent light, and the reflected image was observed with naked eyes, and evaluated by the following criteria.

○: Reflected image of the fluorescent light can be clearly confirmed.
Δ: Reflected image of the fluorescent light can be confirmed.
X: Reflected image of the fluorescent light is blurred.
X X: Reflected image of the fluorescent light is markedly blurred.

<Coloring Property>

By using a commercially available ink jet printer (manufactured by Seiko Epson Co., G860), a degree of dullness of a composite black comprising a mixed color of C, M and Y, and a coloring density of each color of C, M and Y were observed with naked eyes. Evaluation was carried out by the following mentioned criteria.

○: No dullness, and coloring property is good.
Δ: Dullness can be slightly admitted but good.
X: Dullness can be admitted, and coloring property is low.
X X: Strong dullness can be admitted, and coloring property is low.

TABLE 2

| Sample | Powder dropping | Ink absorb-ability | Feel of surface unevenness | Glossiness | Image clarity | Coloring property |
|---|---|---|---|---|---|---|
| Example 11 | ◎ | ○ | ○ | ◎ | ○ | ○ |
| Example 12 | ◎ | ○ | ○ | ◎ | ○ | ○ |
| Example 13 | ◎ | ○ | ○ | ◎ | ○ | ○ |
| Example 14 | ◎ | ○ | ○ | ◎ | ○ | ○ |
| Example 15 | ◎ | ○ | ○ | ◎ | ○ | ○ |
| Example 16 | ◎ | ○ | ○ | ◎ | ○ | ○ |
| Example 17 | ◎ | ○ | ○ | ◎ | ○ | ○ |
| Example 18 | ○ | ○ | ○ | ◎ | ○ | ○ |
| Example 19 | Δ | ○ | ○ | ◎ | ○ | ○ |

TABLE 2-continued

| Sample | Powder dropping | Ink absorb-ability | Feel of surface unevenness | Glossiness | Image clarity | Coloring property |
|---|---|---|---|---|---|---|
| Example 20 | ◎ | Δ | ○ | ◎ | Δ | ○ |
| Example 1 | Δ | ○ | ○ | ◎ | ○ | ○ |
| Example 5 | Δ | ○ | ○ | ◎ | ○ | ○ |
| Comparative example 7 | X | ○ | ○ | ◎ | X | X |
| Comparative example 8 | Δ | X | ○ | ◎ | X | X X |
| Comparative example 3 | ◎ | ○ | ○ | X | X X | ○ |
| Comparative example 4 | ◎ | ○ | ○ | X | X X | X |
| Comparative example 5 | ◎ | ○ | ○ | ◎ | X | ○ |
| Comparative example 6 | ◎ | ○ | X | ○ | ○ | ○ |

From the above-mentioned results, it can be understood that according to the present invention, powder dropping at the time of cutting was controlled, and an ink jet recording material in which the feel of surface unevenness was cancelled without impairing ink absorbability, glossiness, image clarity and coloring property can be obtained. Example 19, Example 1 and Example 5 are samples in which the ratio of the amount of the hydrophilic binder to the total amount of the inorganic fine particles having an average secondary particle size of 500 nm or less and the pearlescent pigment in the ink-receptive layer A is smaller than the ratio of the amount of the hydrophilic binder to the amount of the inorganic fine particles having an average secondary particle size of 500 nm or less in the ink-receptive layer B, so that they gave the results that powder dropping had been observed. Example 20 is a sample in which the ratio of the amount of the hydrophilic binder to the total amount of the inorganic fine particles having an average secondary particle size of 500 nm or less and the pearlescent pigment in the ink-receptive layer A exceeds 0.4, so that its ink absorbability was slightly inferior, and image clarity was not sufficiently satisfied. Comparative example 7 is a sample in which the ink-receptive layer is a single layer containing the pearlescent pigment so that it was inferior in image clarity and coloring property, and it gave the result that powder dropping was remarkable. Comparative example 8 is a sample in which the ink-receptive layer B contains the pearlescent pigment, so that it gave the results that it was inferior in image clarity and coloring property. Comparative example 3 is a sample in which the undercoat layer contains the pearlescent pigment so that it gave the results that it was inferior in glossiness and image clarity. Comparative example 4 is a sample in which the ink-receptive layer A which is a layer nearer to the support contains a matting agent, so that it gave the results that it was inferior in glossiness, image clarity and coloring property. Comparative example 5 is a sample in which the polyolefin resin-coated paper contains the pearlescent pigment, so that it gave the result that it was inferior in image clarity. Comparative example 6 does not contain a pearlescent pigment, so that the feel of surface unevenness was not canceled.

INDUSTRIAL APPLICABILITY

According to the present invention, an ink jet recording material in which a feel of surface unevenness can be cancelled without impairing ink absorbability, glossiness, image clarity, and coloring property can be provided.

The invention claimed is:

1. An ink jet recording material which comprises at least two layers of ink-receptive layers mainly containing inorganic fine particles having an average secondary particle size of 500 nm or less on a support, and an ink-receptive layer nearer to the support contains a pearlescent pigment, wherein an amount of the pearlescent pigment to be added to an ink-receptive layer nearer to the support is in the range of 12.5 to 30% by weight based on an amount of a solid component of the inorganic fine particles having an average secondary particle size of 500 nm or less and the support is a resin-coated paper having a resin layer on at least one surface of a base paper.

2. The ink jet recording material according to claim 1, wherein the ink-receptive layer contains a hydrophilic binder, a ratio of an amount in weight of the hydrophilic binder based on a total amount in weight of the inorganic fine particles and the pearlescent pigment contained in an ink-receptive layer nearer to the support is larger than a ratio of an amount in weight of the hydrophilic binder based on an amount in weight of the inorganic fine particles contained in an ink-receptive layer apart from the support, and the said ratio of an ink-receptive layer nearer to the support is 0.4 or less.

3. The ink jet recording material according to claim 2, wherein a ratio of an amount in weight of the hydrophilic binder based on an amount in weight of the inorganic fine particles contained in the ink-receptive layer apart from the support is in the range of 0.05 to 0.25.

4. The ink jet recording material according to claim 1, wherein the ink-receptive layer apart from the support does not substantially contain the pearlescent pigment.

5. The ink jet recording material according to claim 1, wherein the ink-receptive layer nearer to the support contains the inorganic fine particles in an amount of 50% by weight or more based on the whole solid component of the ink-receptive layer.

6. The ink jet recording material according to claim 1, wherein a dry coated amount of the ink-receptive layer nearer to the support is 60% by weight or less based on the solid component of whole ink-receptive layers.

7. The ink jet recording material according to claim 2, wherein a weight ratio of the hydrophilic binder to the inorganic fine particles in the ink-receptive layer nearer to the support is in a range of 5 to 50% by weight.

* * * * *